United States Patent [19]

Pickett

[11] 4,258,754

[45] Mar. 31, 1981

[54] METHOD AND APPARATUS FOR FLUID SOUND AMPLIFICATION AND DETECTION OF LOW FREQUENCY SIGNALS

[76] Inventor: Charles G. Pickett, 293 Greenbrook Rd., North Plainfield, N.J. 07060

[21] Appl. No.: 3,285

[22] Filed: Jan. 15, 1979

[51] Int. Cl.[3] ..... F15C 1/02

[52] U.S. Cl. ..... 137/819; 137/804; 137/828

[58] Field of Search ..... 137/819, 820, 834, 842, 137/831, 828, 815, 821, 839, 836, 804, 840, 841; 235/200 PF

[56] References Cited

U.S. PATENT DOCUMENTS

| | | | |
|---|---|---|---|
| 3,428,068 | 2/1969 | Howie | 137/842 |
| 3,500,845 | 3/1970 | Bellman | 137/821 |
| 3,552,414 | 1/1971 | Sutton | 137/821 |
| 3,566,689 | 3/1971 | Ringwall | 137/804 |
| 3,570,514 | 3/1971 | Sutton et al. | 137/819 |
| 3,628,551 | 12/1971 | Mayer | 137/842 |
| 3,999,625 | 12/1976 | Pickett | 137/828 |

FOREIGN PATENT DOCUMENTS

| | | | |
|---|---|---|---|
| 2509373 | 4/1975 | Fed. Rep. of Germany | 137/842 |

*Primary Examiner*—Gerald Goldberg
*Assistant Examiner*—Denis E. Corr
*Attorney, Agent, or Firm*—Staas and Halsey

[57] ABSTRACT

A new method and apparatus for fluid sound amplification and detection having enclosed within a predetermined sized housing a fluid supply emitter in combination with a signal input port and spaced a predetermined distance therefrom along an axis offset a determined distance from the fluid supply emitter axis, at least one receiver, the receiver being responsive to gradient differences in fluid pressure as effected by laminar flow of the fluid from the emitter, a filter connected to the receiver for removing relatively high frequency noise, a diaphragm coupler receiving the output of the filter, the coupler having an output for use as a signal input to another predetermined sized housing, emitter, signal input port and at least one receiver combination. A suitable input transducer is connected to the signal input port of the first housing combination and a suitable output transducer such as a recording microphone and oscilloscope is connected to a receiver output of the second housing combination.

6 Claims, 7 Drawing Figures

METHOD AND APPARATUS FOR FLUID SOUND AMPLIFICATION AND DETECTION OF LOW FREQUENCY SIGNALSBACKGROUND OF THE INVENTION

1. Field of the Invention

This invention relates generally to fluid sound amplification and detection devices and especially for use in the amplification and detection of extremely low frequency signals.

2. Description of The Prior Art

A common problem with known type fluid sound amplification and detection systems and apparatus is that they normally use the turbulent flow aspects of fluid flow which inherently involves a lot of noise. Also, known type devices do not amplify the very low frequencies more than the higher frequencies, and especially do not amplify them in inverse proportion to the frequency.

SUMMARY OF THE INVENTION

An object of the present invention is to provide a new method for fluid sound amplification and detection which increases the amplification of the low frequencies of a signal more than the high frequencies thereof.

A further object of this invention is to provide an apparatus for detecting low frequency signals and amplifying them through the use of fluid flow structure for later conversion to an amplified usable output signal.

A further object of this invention is to provide a method and apparatus for converting extremely low frequency signals in the range of zero through 300 Hertz (Hz) to usable amplified signals, and furthermore to increase the amplification of the band of signals in inverse proportion to the increase in frequency thereof.

A still further object of this invention is to provide a method of fluid amplification which involves the laminar flow characteristics of a fluid stream rather than the turbulent aspects thereof, and also wherein inherent noise of the fluid stream may be eliminated.

Another still further object of the present invention is to provide an emitter and input signal port combination structure of very efficient design, as well as receiver output structure of similar very efficient design.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 7:
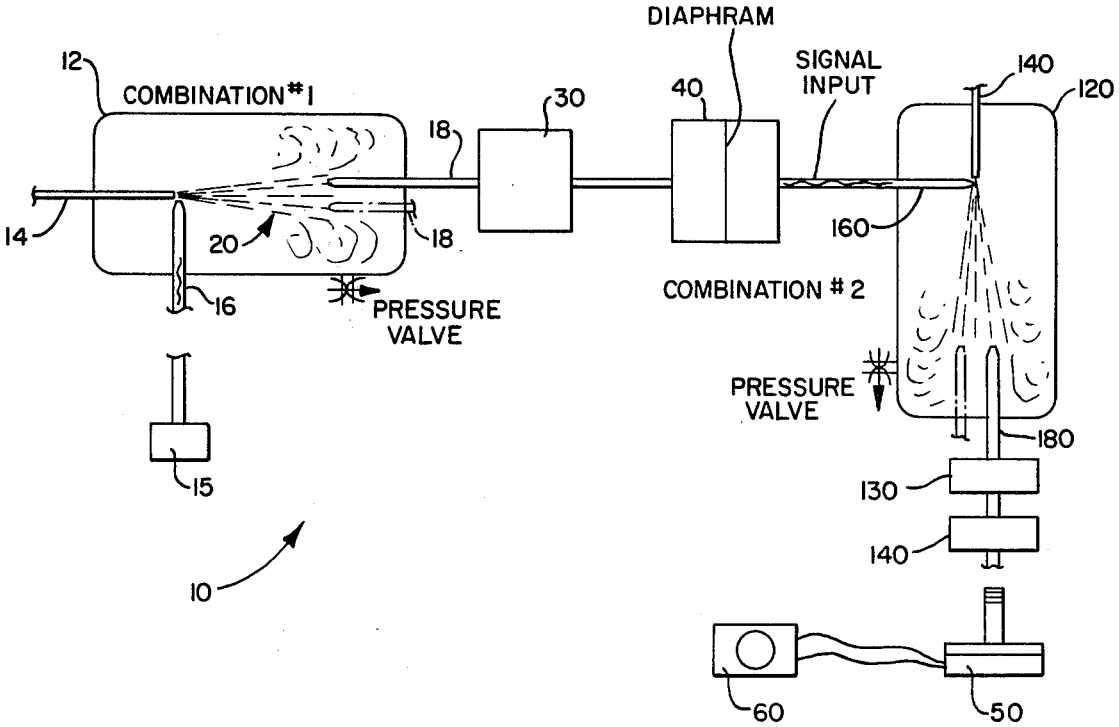
FIG. 7 is a schematic showing of an entire system for the method and apparatus of the present invention.

Referring to FIG. 7 of the drawing, reference numeral 10 indicates the entire system for the method and apparatus of the present invention. Reference numeral 12 indicates the first combination of housing, emitter supply of pressurized fluid 14, signal input port 16, and dual receiver output ports 18. The laminar flow fluid stream is indicated generally by reference numeral 20. Only one of the receiver output ports is shown connected, but in actual practice both of them would have connections to the remaining components of the system, as described below.

The next component of this system is a noise filter 30, which in turn is connected to a diaphragm coupler 40. The output of the coupler 40 is used for connection to the signal input port 160 of a second housing combination 120. The second housing combination has a pressured fluid flow emitter supply 140, and dual receiver outputs 180. The outputs in turn may each by connected, through suitable filters 130 and couplers 140, in the preferred embodiment, to a recording microphone 50 and oscilloscope 60 for displaying to an operator the amplified output as produced by the device from a low frequency input. A conventional input transducer, responsive to low frequency signals, is indicated at 15. Instead of an oscilloscope 60, a chart recorder or similar indicator (not shown) may be used.

It is believed that the new improved results achieved by this invention in essence depends upon what may be called amplification through the use of the cross-sectional velocity gradient curve of a laminar flow stream. Prior work in the area of fluid amplification employed the turbulation phenomenon by which an increase and decrease in output flow was governed by the laminar or turbulent state of the stream, and employed a shelf at an angle of from 2° to 6° at the junction point of emitter and signal ports to control the state of the laminar flow. In this prior work, the emitter and receiver were directly in line on the same axis.

Normally, a laminar stream exhibits the qualities of multilayers of air particles flowing in a somewhat straight line. Turbulent flow on the other hand exhibits an erratic flow pattern with the air particles being disorientated and directed in many different directions.

Figure 1:
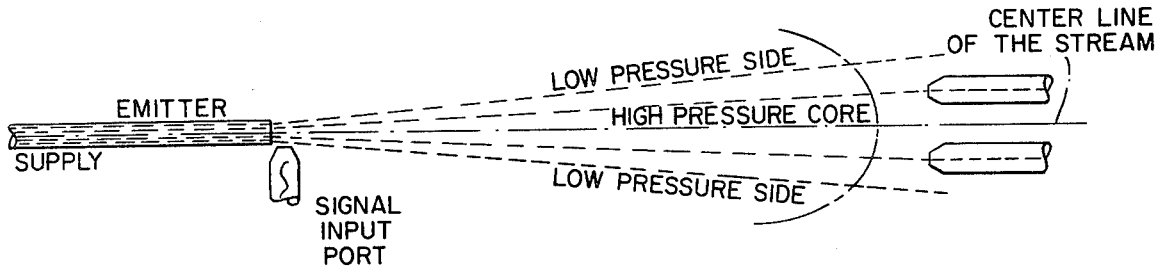
FIG. 1 is a schematic view of the principle of operation of the emitter, input signal port, and receiver output combination of the present invention.

Looking at FIG. 1 of the drawings, a laminar flow 22 from an emitter 14 supplied by pressurized air is shown.

If we measure the velocity across the laminar stream as emitted from the emitter, it has been found that the particles at the center of the stream are travelling faster than the particles at the outside of the stream. A curve M—M drawn across the stream appears as a bullet nose. By converting the flow to pressure, it can be observed that the pressure at the center of the stream is higher than the pressure at the outside of the stream.

As shown in FIG. 1, a receiver 18 placed approximately in line with the emitter but on an axis slightly offset from the axis of the emitter will be in an area of medium pressure, that is between the highest pressure along the center line of the emitter and within the low pressure of the outside of the laminar flow stream.

Figure 3:
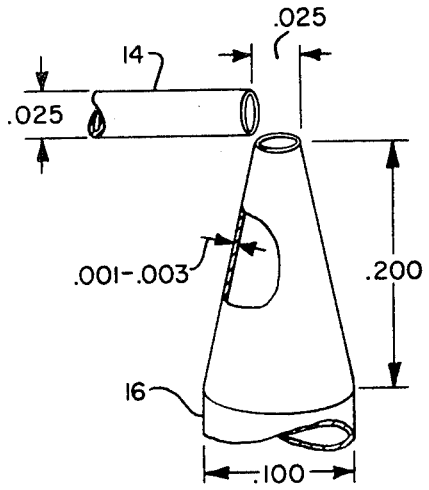
FIG. 3 is a enlarged perspective view of the encircled portion A of FIG. 2.

A practical application of the present invention is as follows. An emitter tube of a diameter of 0.025 inches and a signal input port comprising a perpendicular passage to the output mouth of the emitter with an opening of a diameter of 0.025 inches at the point of intersection and angling away from the point of intersection for a distance of 0.200 inches to a dimension of 0.100 inches. This produces a conical tip as best seen in FIG. 3.

Figure 4:
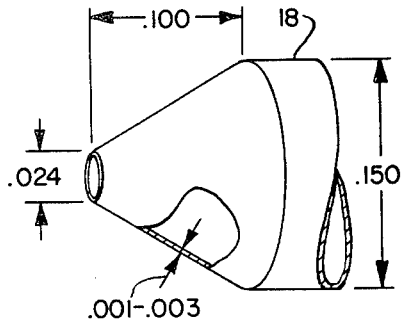
FIG. 4 is an enlarged perspective of the encircled portion B of FIG. 2.

A receiver is shown in FIG. 4 having an entrance hole of 0.25 inches and angling to 0.150 inches a distance of 0.100 inches from the entrance hole. The conical tip opening of the receiver should be mounted a minimum of 0.750 inches from the emitter opening to a maximum of 1.500 inches from the emitter opening. The axis of the receiver should be displaced from the center line axis of the emitter a distance sufficiently such that the fan effect of the laminar stream from the emitter is evenly split between the high pressure center core of the stream and the low pressure outside of the stream. A distance of 0.024 inches works well.

Tests have shown that for a 0.025 inch emitted stream at an input pressure of 1.7 inches $H_2O$ to the emitter, and a distance of 0.750 inches between the emitter and receiver, the difference in pressure between the high pressure core and the outside of the laminar flow is 6 MM $H_2O$. When the receiver is positioned midway between the high pressure core of the stream and the extreme outside edge of the stream, approximately 3 MM $H_2O$ is indicated. Converting this to inches of $H_2O$ we have 0.118 inch $H_2O$, and then converting to Dynes/cm$^2$ we have 29.2 Dynes/cm$^2$. A change in pressure of 29.2 Dynes/cm$^2$ will produce a sound of 103.3 dB.

If a signal input is now applied to the input port adjacent the mouth of the emitter to effect a deflection in the presently unobstructed laminar flow stream, the stream will be made to move across the receiver(s) as the input signal is applied. Thus, as shown in FIG. 1, as the input signal goes positive, the emitter stream is raised and the pressure within the upper receiver increases due to the fact that the high pressure core is approaching the receiver input hole. Conversely, as the input signal goes negative, the stream is pulled down by the negative pressure at the junction of the input signal port and the mouth of the emitter, which causes the emitter stream to swing downward past the mouth of the receiver and causes a lowering of pressure within the receiver as the outside of the stream approaches. Simultaneously, the same effect is experienced by the lower receiver, but in the reverse, or 180° phase to the upper receiver. Thus, as can be easily visualized, a single input signal can produce two output signals through the dual receiver outputs with the respective outputs being inverted to each other.

It has been discovered that it is extremely important to have the thickness of metal adjacent the opening of the emitter and signal ports made as thin as possible, as shown in enlarged form in FIG. 3. Preferably the material near the openings should be a thickness of 1/1000 of an inch or so. Similarly, the material adjacent the opening of the receiver, as shown in enlarged form in FIG. 4, should also be as thin as possible, preferably of 1/1000 of an inch or so.

Figure 2:
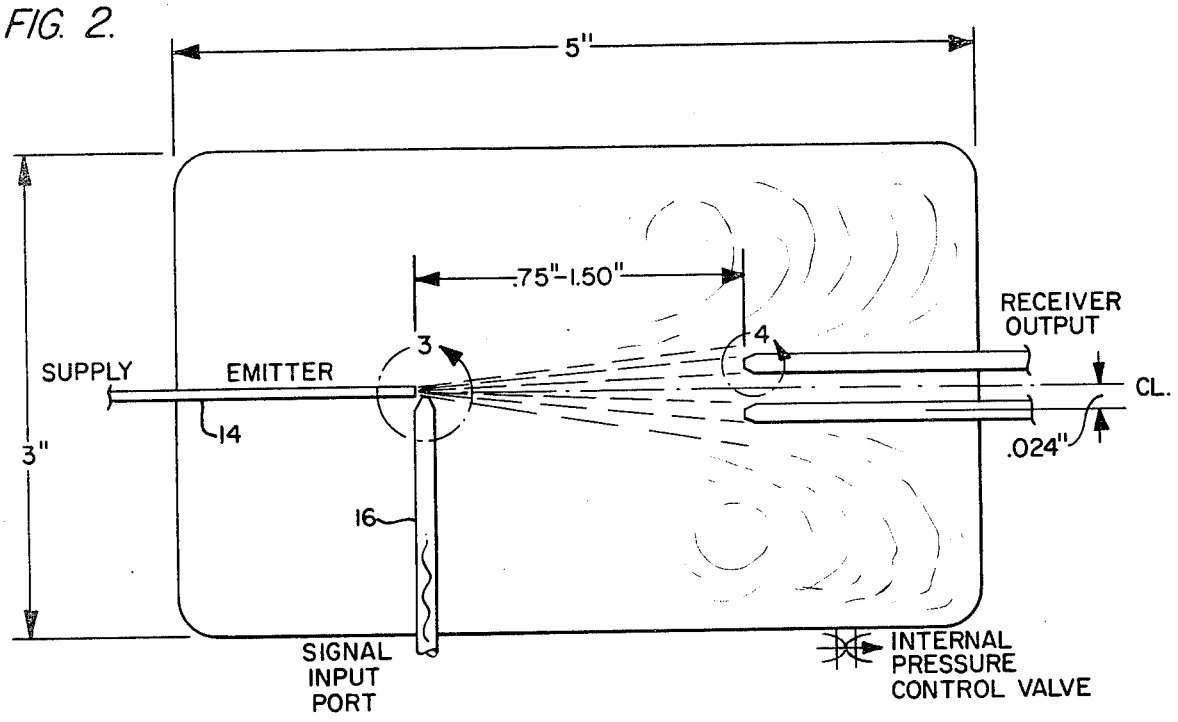
FIG. 2 is a side elevation of a housing with emitter and signal input port, and dual receiver, outputs.

It has also been discovered that a greatly improved result is achieved if the combination of emitter, signal input port, and receiver(s) are mounted within a housing which is under pressure. By the use of a pressurized atmosphere surrounding the emitter stream and the receiver, increased amplification and greater sensitivity result. While the device will function at atmospheric pressure, i.e., zero PSIG, a greatly improved result is achieved by having the emitter, signal port, and receiver contained in a housing which is pressurized between 0.050 inches $H_2O$ and 0.070 inches $H_2O$. This pressure may be provided by the spent or non-used portion of the laminar stream. That is, the input fluid is under pressure, and by providing a housing with a pressure control valve as indicated schematically in FIG. 2, the exhaust pressure of the laminar stream can be utilized to effect the desired pressure within the housing.

A housing of 3 inches in diameter by 5 inches in length with an internal pressure of 0.05 to 0.07 inches $H_2O$ above the outside ambient pressure has been found to work extremely well. If the inside pressure is decreased below the 0.05 preferred minimum, the response to low frequency sound decreases. Therefore, it is preferred to keep the pressure to at least this amount.

Figure 5:
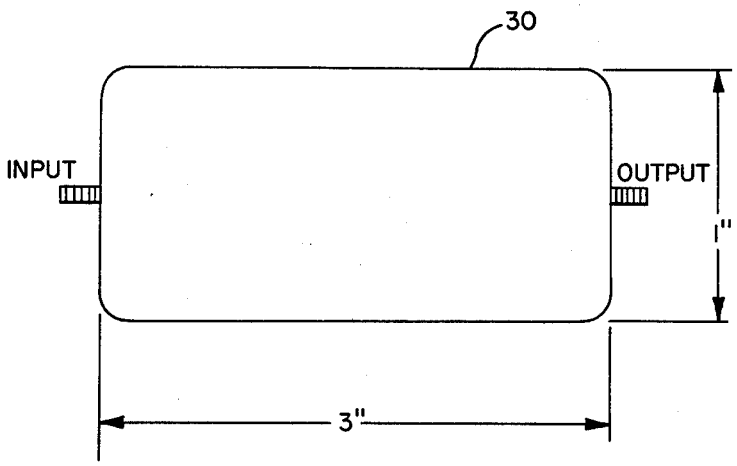
FIG. 5 is a schematic showing of a noise filter as used with the subject invention.

Also during tests, it was found to be necessary, in order to eliminate the 3,000 to 4,000 Hertz noise which is naturally generated by the emitted stream, that a filter should be included with the system. A filter consisting of a housing of approximately 1 inch by 3 inch by 1 inch, or roughly 3 cubic inches has been found to be satisfactory. This is shown in FIG. 5 and is essentially an enclosed housing having an input at one end and an output at the other. When this filter is used in combination with the housing 12, and with the indicated internal pressure, even greater sensitivity to a low frequency of signal of 10 cycles per second results.

Figure 6:
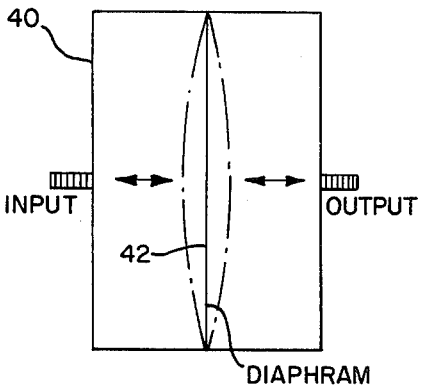
FIG. 6 is a schematic showing of a diaphragm coupler device.

A device consisting of a housing, an emitter, signal input port, receiver(s), internal pressure regulation, and filter can be connected directly to an output indicating structure, such as a microphone and oscilloscope as indicated by 50 and 60 in FIG. 7. However, even better results can be achieved by adding additional stages to the first combination, as shown in FIGS. 6 and 7.

The device described so far, normally will permit sensitive amplification down to approximately 10 cycles per second. However, in order to go down to 6 cycles per second and even lower, such as practically zero cycles per second, it is necessary to use additional structure as follows.

Due to the sensitivity of the emitter, signal input, and receiver combination, saturation is experienced at about 60 Dynes/cm$^2$ input. Since the output of a single housing combination in a no signal input state is greater than the maximum allowable input to a second or third housing combination, it is necessary to feed the output to similar adjoining combinations in series with static couplers. It is desirable that only the change in pressure due to an input signal to the first housing combination of emitter, signal input port, receiver, and pressure control valve, be fed to the second similar combination. In order to accomplish this, a coupler device is used. This coupler, shown in FIG. 6, consists of a predetermined volume, and is made with a housing 40 of plastic or other material which is separated across the center by a diaphragm 42. The housing 40 may be tubular, rectangular, square, or practically any shape as long as the cubic volume is adequate. A volume of 0.250 inches has been found to perform well.

When the input of this coupler device is connected to an output receiver of combination #1, the diaphragm responds to an increased pressure in the cavity. If there is no signal input into the first combination, the modulated output from the receiver 18 will be static, i.e., nothing, and the diaphragm will remain in a static condition. However, if a signal is imposed on the emitter stream 20 of the housing combination #1, a change in flow will result at the receiver 18, thus changing the pressure on the diaphragm and causing it to either distend or relax. This distention or relaxation causes a corresponding change in flow at the output of the coupler, and this output is then fed to the input of the next housing combination.

Such a complete system, as shown in FIG. 7, yields an amplification factor of 350 times at a frequency of 6 cycles per second. The amplification factor diminishes to approximately 1 time at 300 cycles per second. Therefore, it can be seen that as the frequency is decreased from a relatively high frequency of 300 Hertz down to 6 Hertz, or below, the amplification factor is greatly increased. Tests indicate that the amplification factor tends to increase even further as the cycles per second are reduced below 6. It is expected this increase will continue exponentially down to the minimum cycles per second.

In summary, the present invention is an amplification system for use with low frequency sound input utilizing an electrical transducer to convert the output such that it can be read or observed on an electrical indicator, such as an oscilloscope or chart recorder. The input to the system can be anything that is capable of picking up a low frquency signal i.e., 0–300 Hz.

An application of this system could be for earthquake prediction by observing shifts in the earths crust through observing the low frequency output of the shifts; or low frequency output from the human body, the heart, for example, can run to 5 Hz at which there is no present good method for detection and amplification. The response of ordinary microphones drops off drastically as the frequency lowers. However, with the system of the present invention, the amplification increases as the frequency lowers.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

I claim:

1. A fluid amplifier device for low frequencies comprising:
- a housing having;
  - emitter means aligned along a predetermined axis for converting fluid under pressure into a laminar stream;
  - signal input means associated with said emitter for traversely deflecting the laminar stream; and
  - at least one receiver means aligned along an axis substantially parallel to said predetermined axis but offset a predetermined distance therefrom, wherein said housing is provided with means for maintaining pressure in said housing within a desired range, said desired range of pressure is from a minimum of 0.050 inches of $H_2O$ to a maximum of 0.070 inches of $H_2O$, said signal input and receiver means each include conical tips which are extremely thin near the openings thereof, and wherein the extremely thin tips of the signal input port and receiver are in the range of 0.001 to 0.003 inches in thickness.

2. A fluid amplifier device for low frequencies comprising:
- a housing having;
  - emitter means aligned along a predetermined axis for converting fluid under pressure into a laminar stream;
  - signal input means associated with said emitter for traversely deflecting the laminar stream; and
  - at least one receiver means aligned along an axis substantially parallel to said predetermined axis but offset a predetermined distance therefrom, together with an input of a noise filter connected to the output of the at least one receiver means, a diaphragm coupler input connected to the output of the noise filter, and in turn an output of the coupler connected to a second housing combination having emitter, signal input and receiver means similar to the first housing.

3. The device of claim 2, together with an input transducer connected to the signal input means of the first housing, and output transducer connected to the at least one receiver means of the second housing, and a readable output means connected to said output transducer for interpretation by an operator.

4. A fluid amplifier and detection apparatus comprising: a first housing having in combination therewith an emitter having a tip opening for supplying a laminar fluid flow stream along a predetermined axis, a signal input port having a conical tip at substantially right angles to the emitter tip opening, and closely adjacent thereto, the tips of said openings of the emitter and signal input port being extremely thin near the openings thereof, two receivers with conical tips aligned along axes parallel to the axis of the emitter but slightly offset therefrom, the spacing distance between the output opening of the emitter tip and the input openings of the receiver tips being between 0.75 and 1.50 inches, a noise filter connected to each of the receivers, each noise filter in turn connected to a diaphragm coupler, with each coupler in turn connected to second and third housings, each of said second and third housings having in combination signal input ports to which the diaphragm couplers are connected, closely associated therewith an emitter for effecting a laminar fluid flow stream, and each housing in turn having at least two receivers with the spacing of the emitters and receivers of the second and third housings being the same as the spacings of these elements in the first housing, and at least one receiver of the second and third housings being connected to transducer means for changing low frequency signals as amplified in inverse proportion to their frequency to a meaningful readable output.

5. A method of amplification of low frequency signals including the steps of:
- emitting fluid under pressure in a stream of laminar orientated particles;
- said stream having a pressure flow gradiant thereacross with the greatest pressure being at the central core of the laminar flow stream and the lowest pressure at the outside circumference thereof;
- positioning a receiver approximately midway between the center core and the outside circumference of the laminar flow stream in order to detect variations in pressure thereof when the stream is deflected traversely of the receiver;
- modulating said fluid stream by inputting a low frequency signal traversely thereto in order to effect a movement of said stream traversely across the receiver to produce an amplified signal at the receiver output;
- filtering noise from the receiver output as produced by turbulence of the laminar flow stream;
- and detecting the amplified low frequency signals as provided at the output of the filter.

6. The method of claim 5, together with the additional steps of transferring only modulated pressure change from said filter output by use of a coupler; and feeding the modulated pressure change to another fluid amplification stage for increasing the overall amplification of low frequency signals in inverse proportion to the frequency of the input signals.

* * * * *